US011383794B2

(12) United States Patent
Lee et al.

(10) Patent No.: US 11,383,794 B2
(45) Date of Patent: Jul. 12, 2022

(54) METHOD AND APPARATUS FOR TRANSFERRING LIQUID CARGO IN PRESSURIZATION TYPE

(71) Applicant: SAMSUNG HEAVY IND. CO., LTD, Gyeonggi-do (KR)

(72) Inventors: Jong Gyu Lee, Gyeongsangnam-do (KR); Kyungwon Lee, Gyeongsangnam-do (KR)

(73) Assignee: SAMSUNG HEAVY IND. CO., LTD, Gyeonggi-Do (KR)

( * ) Notice: Subject to any disclaimer, the term of this patent is extended or adjusted under 35 U.S.C. 154(b) by 278 days.

(21) Appl. No.: 16/643,255

(22) PCT Filed: Aug. 31, 2018

(86) PCT No.: PCT/KR2018/010156
§ 371 (c)(1),
(2) Date: Feb. 28, 2020

(87) PCT Pub. No.: WO2019/045523
PCT Pub. Date: Mar. 7, 2019

(65) Prior Publication Data

US 2020/0255099 A1 Aug. 13, 2020

(30) Foreign Application Priority Data

Sep. 1, 2017 (KR) ..... 10-2017-0111818
Sep. 1, 2017 (KR) ..... 10-2017-0111823

(51) Int. Cl.
*B63B 25/16* (2006.01)
*F17C 9/02* (2006.01)
(Continued)

(52) U.S. Cl.
CPC ..... *B63B 25/16* (2013.01); *F17C 9/02* (2013.01); *B63H 21/38* (2013.01); *F17C 6/00* (2013.01);
(Continued)

(58) Field of Classification Search
CPC ..... B63B 25/00; B63B 25/16; B63H 21/00; B63H 21/38; F17C 6/00; F17C 9/02;
(Continued)

(56) References Cited

U.S. PATENT DOCUMENTS 4,449,543 A * 5/1984 Greene, Jr. ..... B01J 4/008 137/101.11
5,203,828 A * 4/1993 Strain ..... B63B 25/12 114/74 R
7,497,180 B2 * 3/2009 Karlsson ..... F17C 7/00 114/74 R

FOREIGN PATENT DOCUMENTS

CN 102472430 A 5/2012
CN 104837724 A 8/2015
(Continued)

OTHER PUBLICATIONS

International Search Report issued by the Korean Patent Office acting as the International Searching Authority in relation to International Application No. PCT/KR2018/010156 dated Dec. 18, 2018 (with English Translation).
(Continued)

*Primary Examiner* — Lars A Olson
(74) *Attorney, Agent, or Firm* — Carter, DeLuca & Farrell LLP

(57) ABSTRACT

The present disclosure provides an apparatus for transferring a liquid cargo. The apparatus for transferring a liquid cargo according to an embodiment of the inventive concept may include a liquid cargo transfer line connected to a liquid cargo storage tank, a drum connected to the liquid cargo
(Continued)

transfer line and providing a space for storing a liquid cargo, and a pressing unit for pressing the liquid cargo storage tank so that the liquid cargo stored in the liquid cargo storage tank is supplied to the drum through the liquid cargo transfer line.

14 Claims, 13 Drawing Sheets

(51) Int. Cl.
*B63H 21/38* (2006.01)
*F17C 6/00* (2006.01)

(52) U.S. Cl.
CPC .. *F17C 2265/031* (2013.01); *F17C 2265/033* (2013.01); *F17C 2265/037* (2013.01); *F17C 2270/0105* (2013.01)

(58) Field of Classification Search
CPC ..... F17C 13/00; F17C 13/02; F17C 13/04; F17C 2265/031; F17C 2265/033; F17C 2265/037; F17C 2270/0105
USPC ..... 114/74 R
See application file for complete search history.

(56) References Cited

FOREIGN PATENT DOCUMENTS

| | | | |
|---|---|---|---|
| CN | 105683039 | A | 6/2016 |
| CN | 104956140 | B | 11/2016 |
| CN | 107614858 | A | 1/2018 |
| JP | 47-19417 | A | 9/1972 |
| JP | 50-5477 | B1 | 3/1975 |
| JP | 61-45837 | A | 3/1986 |
| JP | 63-28998 | U | 2/1988 |
| KR | 1020110021526 | | 3/2011 |
| KR | 101076268 | B1 | 10/2011 |
| KR | 1020140017166 | A | 2/2014 |
| KR | 1020150093003 | | 8/2015 |
| KR | 1020150101620 | | 9/2015 |
| KR | 101606574 | B1 | 3/2016 |
| KR | 1020160074983 | | 6/2016 |
| KR | 1020160129403 | | 11/2016 |
| KR | 101738027 | B1 | 5/2017 |
| KR | 101770917 | B1 | 8/2017 |

OTHER PUBLICATIONS

Japanese Office Action issued in corresponding JP Patent Application No. 2020-512583, dated Feb. 8, 2022, pp. 1-4, with English translation.

* cited by examiner

METHOD AND APPARATUS FOR TRANSFERRING LIQUID CARGO IN PRESSURIZATION TYPE

CROSS-REFERENCE TO RELATED APPLICATIONS

This application is a national phase entry under 35 U.S.C. 371 of PCT International Application No. PCT/KR2018/010156 filed Aug. 31, 2018, which claims the benefit of and priority to Korean Patent Application No. 10-2017-0111823 filed Sep. 1, 2017, and Korean Patent Application No. 10-2017-0111818 filed Sep. 1, 2017, the disclosure of each of which is expressly incorporated herein by reference in their entirety.

TECHNICAL FIELD

The present disclosure herein relates to a pressing-type apparatus for transferring a liquid cargo and a method thereof.

BACKGROUND ART

A pump tower, which is a pipe structure, is provided in a cargo tank in order to load or discharge a liquefied natural gas (LNG) in a LNG carrying vessel including a typical GTT membrane-type cargo tank. The pump tower is used as a liquid line for discharging the LNG through a pipe while simultaneously supporting all sorts of pipes and a LNG cargo pump.

FIG. 1 is a view illustrating a typical pump tower installed in a cargo tank.

Referring to FIG. 1, when the LNG is typically loaded and discharged, the LNG is transferred through the same liquid line at the outside of the cargo tank, but the LNG is loaded through a filling pipe 2 and discharged through a discharge pipe 4 at the inside of the cargo tank. This is because when the discharge pipe 4 is used for filling, the cargo pump 5 may be damaged due to a reverse rotation, and when the cooled LNG is loaded through the discharge pipe, which is a structural support, a stress may be generated in an entire structure due to thermal contraction as a submerged-type LNG cargo pump 5 is attached at a lowermost end of the discharge pipe 4.

Particularly, since the LNG cargo pump 5 may not be instantly repaired in case of malfunction, two LNG cargo pumps are necessary for each cargo tank 1, and separate additional line is required to install an emergency pump, thereby requiring economic costs for building a facility.

Also, a remote controllable valve is required in order to resolve the above-described limitation by including a separate branch line. However, this method is also impossible because an actuator capable of operating under an extremely low temperature environment is hardly developed. Thus, a LNG loading and discharging system in a tank of a typical vessel loads the LNG by including the filling pipe 2 separated from the discharge pipe 4.

However, since the fluid loading and discharging structure in the tank of the typical vessel requires the separate filling pipe 2, a constitution thereof is complex, and since a member for supporting the filling pipe 2 in addition to the filling pipe 2 is required, economic costs increases for building the facility. Thus, the fluid loading and discharging structure having high economic feasibility by minimizing components related to the liquid lines is demanded.

Therefore, a technique development capable of filling a fluid through the discharge pipe 4 is required so that the fluid loading and discharging structure in the tank satisfies the above-described requirements.

SUMMARY

Technical Problem

The present disclosure provides a pressing-type liquid cargo transfer apparatus capable of simplifying a constitution of loading and discharging a liquid cargo in a cargo tank by unifying a filling pipe and a discharge pipe, and a method thereof.

The object of the present invention is not limited to the aforesaid, but other objects not described herein will be clearly understood by those skilled in the art from descriptions below.

Technical Solution

An embodiment of the inventive concept provides an apparatus for transferring a liquid cargo, the apparatus including: a liquid cargo transfer line connected to a liquid cargo storage tank; a drum connected to the liquid cargo transfer line and configured to provide a space for storing a liquid cargo; and a pressing unit configured to press the liquid cargo storage tank so that the liquid cargo stored in the liquid cargo storage tank is supplied to the drum through the liquid cargo transfer line.

In an embodiment, the apparatus may further include a filling line connected to the liquid cargo transfer line and configured to receive the liquid cargo from the outside.

In an embodiment, the pressing unit may include: a compressor configured to receive a boil-off gas from the drum and compress the received boil-off gas; and a gas transfer line configured to supply the boil-off gas, which is compressed in the compressor, to the liquid cargo storage tank.

In an embodiment, the pressing unit may further include a terminal gas line connected to the compressor and configured to supply a boil-off gas from the liquid cargo storage terminal.

In an embodiment, the apparatus may further include a cooling unit configured to prevent temperature increase of the liquid cargo storage tank when the compressed boil-off gas is supplied to the liquid cargo storage tank.

In an embodiment, the cooling unit may include: an injection nozzle installed in the liquid cargo storage tank to inject the liquid cargo; and a cooling supply line configured to connect the injection nozzle with the drum and supply a portion of the liquid cargo stored in the drum to the injection nozzle by an auxiliary pump.

In an embodiment, the pressing unit may further include a bypass line bypassing the compressor and connected to the gas transfer line, and the boil-off gas generated from the liquid cargo storage tank may be supplied between the compressor and the drum through the gas transfer line and the bypass line, compressed in the compressor, and then supplied to a gas demand source.

In an embodiment, the apparatus may further include: a collecting line configured to store surplus boil-off gas, which is remained from the boil-off gas compressed in the compressor after supplied to the gas demand source, in the drum; and an exhaust line branched from the gas transfer line and configured to exhaust a boil-off gas generated from the drum.

In an embodiment, the apparatus may further include: a discharge line connected to a lower portion of the drum in order to unload the liquid cargo stored in the drum; and a main pump installed on the discharge line and configured to apply a transfer pressure to the liquid cargo stored in the drum and pump the liquid cargo.

In an embodiment, the apparatus may further include a drum pressure adjusting part configured to adjust a pressure of the drum in order to constantly maintain a flow amount of the liquid cargo discharged through the discharge line.

In an embodiment, the drum pressure adjusting part may include: a water level detecting member configured to measure a water level of the liquid cargo in the drum; a pressure measuring member configured to measure a pressure of a boil-off gas in the drum; and a controller configured to receive a measured value from the water level detecting member and the pressure measuring member and control a discharge amount of the boil-off gas in the drum. Here, the controller may control a vapor control valve installed on a gas transfer line through which the boil-off gas in the drum is discharged and a control valve installed on the discharge line and the main pump. Also, the controller may control the vapor control valve so that an amount of the boil-off gas exhausted through the gas transfer line decreases when the pressure of the boil-off gas in the drum with respect to the water level of the liquid cargo in the drum is less than a preset ratio, and control the vapor control valve so that the amount of the boil-off gas exhausted through the gas transfer line increases when the pressure of the boil-off gas in the drum with respect to the water level of the liquid cargo in the drum is greater than a preset ratio.

In an embodiment, the pressing unit may prevent pressure decrease of the liquid cargo storage tank by supplying at least one of a boil-off gas supplied from the liquid cargo storage terminal, a boil-off gas generated in the drum, and a gas obtained by evaporating the liquid cargo stored in the drum to the liquid cargo storage tank through the gas transfer line when the liquid cargo is loaded from the liquid cargo storage terminal to the liquid cargo storage tank.

In an embodiment of the inventive concept, a method for transferring a liquid cargo includes: pressing a liquid cargo storage tank by using a boil-off gas so that a liquid cargo stored in the liquid cargo storage tank is transferred to a drum; and discharging the liquid cargo stored in the drum to a liquid cargo storage terminal through pumping of a main pump. Here, wherein the boil-off gas used to press the liquid cargo storage tank uses a compressed boil-off gas obtained by compressing a boil-off gas, which is generated in the drum, in a compressor.

In an embodiment, the pressing of the liquid cargo storage tank may receive and use a boil-off gas generated in the liquid cargo storage terminal when the boil-off gas used to press the liquid cargo storage tank is insufficient, and prevent temperature increase of the liquid cargo storage tank by inserting and pressing the compressed boil-off gas into the liquid cargo storage tank while simultaneously injecting the liquid cargo supplied from the drum.

In an embodiment, a portion of the liquid cargo may be stored in the drum when the liquid cargo is unloaded form the liquid cargo storage tank, cool-down of a pump, which is performed before the main pump is used, may be performed by using the liquid cargo stored in the drum, and a boil-off gas generated during the cool-down of the pump may be supplied to the liquid cargo storage tank.

Advantageous Effects

According to the embodiment of the inventive concept, as the liquid cargo may be filled and discharged through the liquid cargo transfer line, the constitution may be simplified because the separate pump tower is not required in the storage tank, and price competitiveness may increase.

The embodiment of the inventive concept exhibits the special effect of using the liquid cargo for various purposes.

According to the embodiment of the inventive concept, the flow amount discharged may be constantly maintained at all times through adjusting the pressure of the drum The object of the present invention is not limited to the aforesaid, but other objects not described herein will be clearly understood by those skilled in the art from descriptions below.

DETAILED DESCRIPTION

Hereinafter, specific embodiments will be described in detail with reference to the accompanying drawings. The present invention may, however, be embodied in different forms and various modifications and variations can be made in the present invention. However, this does not limit the present invention within specific embodiments and it should be understood that the present invention covers all the modifications, equivalents, and replacements within the idea and technical scope of the present invention. Moreover, detailed descriptions related to well-known functions or configurations will be ruled out in order not to unnecessarily obscure subject matters of the present invention.

In the following description, the technical terms are used only for explaining a specific exemplary embodiment while not limiting the present invention. The terms of a singular form may include plural forms unless referred to the contrary. The meaning of 'include' or 'comprise' specifies a property, a region, a fixed number, a step, a process, an element and/or a component but does not exclude other properties, regions, fixed numbers, steps, processes, elements and/or components.

It will be understood that although the terms such as 'first' and 'second' are used herein to describe various elements, these elements should not be limited by these terms. The terms are only used to distinguish one component from other components.

Hereinafter, the particle separation apparatus of the present invention is described in more detail with reference to the accompanying drawings and, while describing of the accompanying drawings, the same or corresponding components are given with the same drawing number, and its overlapping description will be omitted.

Figure 1:
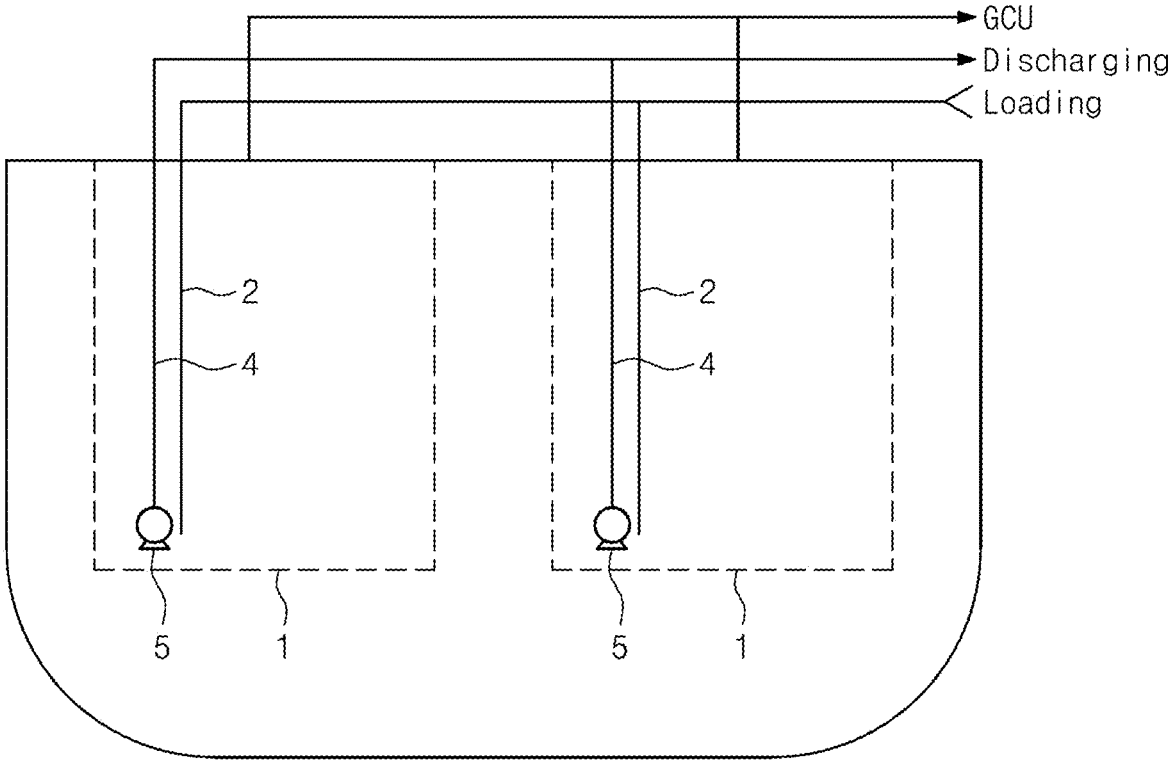
FIG. 1 is a view illustrating a typical pump tower installed in a cargo tank.
Figure 2:
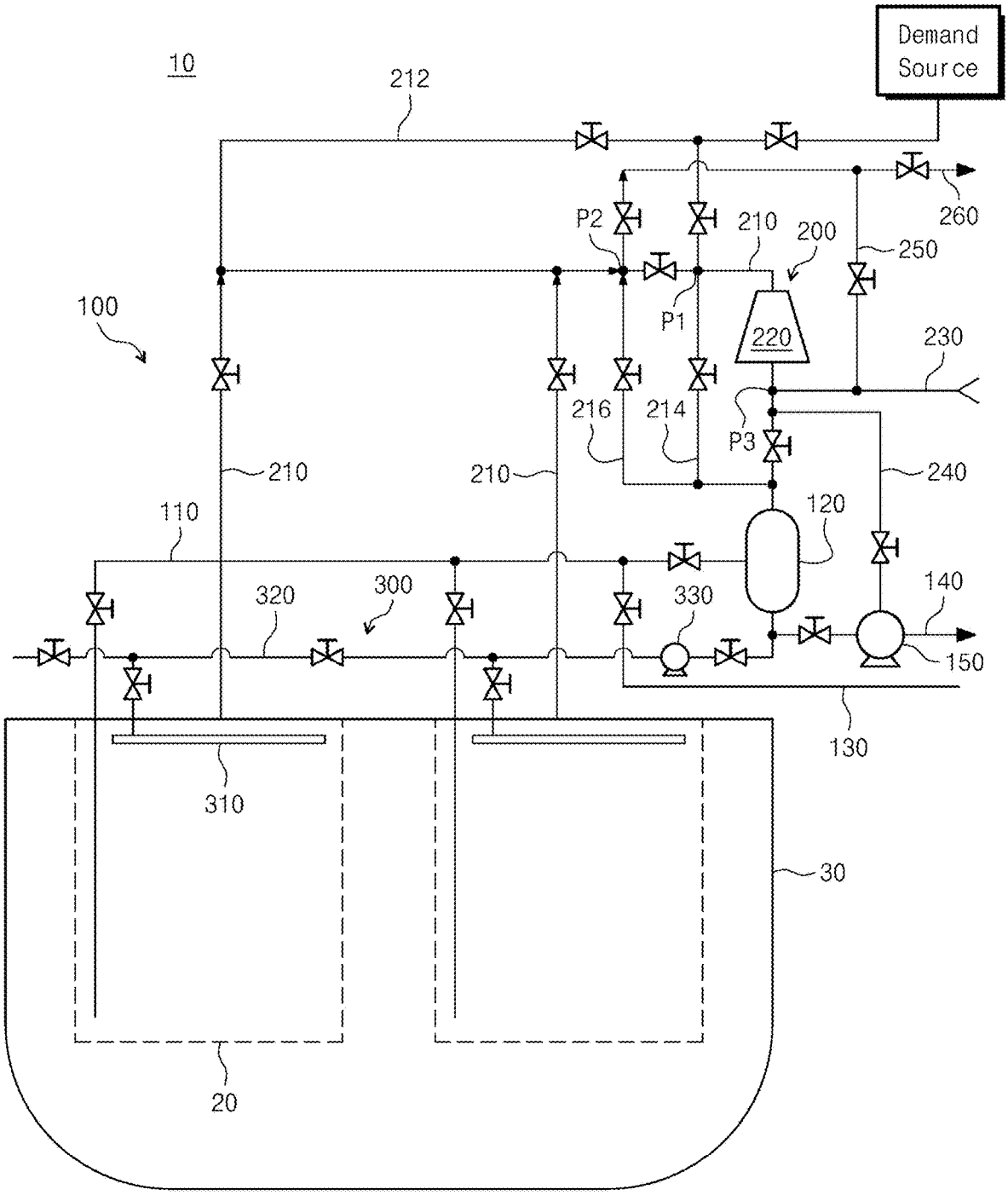
FIG. 2 is a view illustrating a floating-type marine structure with a liquid cargo transfer apparatus applied.

FIG. 2 is a view illustrating a floating-type marine structure with a liquid cargo transfer apparatus applied.

As shown in FIG. 2, a floating-type marine structure 10 includes a hull 30 including liquid cargo storage tanks 20. The liquid cargo is unloaded from the liquid cargo storage tank 20 by an apparatus 100 for transferring a liquid cargo (hereinafter, referred to as a liquid cargo transfer apparatus), which is installed in the hull 30.

Here, when drilling for crude oil or natural gas is performed on the sea, the floating-type marine structure 10 may be a floating production, storage and offloading (FPSO), which is a marine floating structure for temporarily storing the crude oil or the natural gas or processing the same, a floating liquefied natural gas (FLNG), which is a natural gas production and storing facility, or a floating storage and regasification unit (FSRU). However, the embodiment of the inventive concept is not limited thereto. For example, the floating-type marine structure 10 may be a structure in which a storage tank for storing a liquid cargo is installed.

The liquid cargo transfer apparatus 100 according to an embodiment of the inventive concept may perform loading and unloading of a liquid cargo by unifying a filling pipe and a discharge pipe, and transfer a liquid cargo by compressing the liquid cargo stored in the liquid cargo storage tank 20 (hereinafter, referred to as a storage tank) by using boil-off gas stored in a drum 120 without including a submerged transfer pump for applying a transfer pressure to the liquid cargo during an unloading operation.

The liquid cargo transfer apparatus 100 may be appropriately applied when a hydraulic pressure is low, e.g., a small-sized LNG tank or a storage tank of a liquid cargo having an extremely low density (e.g., liquefied hydrogen).

The liquid cargo transfer apparatus 100 may include a liquid cargo transfer line 110, a drum 120, a filling line 130, a pressing unit 200, a cooling unit 300, a discharge line 140, and a main pump 150.

The liquid cargo transfer line 110 passes from a lower portion to an upper portion of the storage tank 20 and is connected to the drum 120 installed on a deck of the hull 30. The filling line 130 is connected to the liquid cargo transfer line 110.

The drum 120 has a storage space for storing the liquid cargo and has a capacity less than the storage tank 20.

The pressing unit 200 presses the storage tank 20 so that the liquid cargo stored in the storage tank 20 is supplied to the drum 120 through the liquid cargo transfer line 110.

For example, the pressing unit 200 may include a compressor 220, a gas transfer line 210, a terminal gas line 230, a pump gas line 240, and a bypass line 250. The compressor 220 is installed on the gas transfer line 210. The compressor 220 receives the boil-off gas from the drum 120 and compresses the received boil-off gas, and the boil-off gas, which is compressed in the compressor 220, (hereinafter, referred to as compressed boil-off gas) is supplied to each of the storage tanks 20 through the gas transfer line 210.

The gas transfer line 210 is connected to an upper end of the storage tank 20. The gas transfer line 210 may be used as a path for supplying the compressed boil-off gas to the storage tank 20 and a path for discharging the boil-off gas of the storage tank. A demand source supply line 212 for supplying the boil-off gas to a demand source may be connected to the gas transfer line 210. The demand source supply line 212 may be connected to a first drum gas line 214. The first drum gas line 214 is branched from the gas transfer line 210, which corresponds to a section between the compressor 220 and the drum 120, and connected to the demand source supply line 212. The first drum gas line 214 may be connected to a first point P1 on the gas transfer line 210 corresponding to a section between the compressor 220 and the storage tank 20.

A second drum gas line 216 may be branched from the first drum gas line 214, and the second drum gas line 216 may be connected to a second point P2 at which the bypass line 250 and the gas transfer line 210 are joined.

The bypass line 250 may be connected to the gas transfer line 210 to bypass the compressor 220 for compressing a boil-off gas generated from the storage tank 20. The bypass line 250 may have one end connected to the second point P2 on the gas transfer line, which corresponds to the section between the compressor 220 and the storage tank 20, and the other end connected to a third point P3 of the gas transfer line 210, which corresponds to a section between the compressor 220 and the drum 120. On the other hand, surplus boil-off gas, which is remained from the boil-off gas compressed in the compressor 220 after supplied to a gas demand source, may move to the drum 120 from the compressor 220 through the first drum gas line 214. As described above, the first drum gas line 214 may be used as a collecting line that collects the boil-off gas as necessary.

An exhaust line 260 is connected to the bypass line 250. The exhaust line 260 may be connected to another demand source (additional demand source) that demands the boil-off gas.

A terminal gas line 230, which receives the boil-off gas from a liquid cargo storage terminal (not shown), is connected to the compressor 220. The pressing unit 200 may receive the boil-off gas from the liquid cargo storage terminal through the terminal gas line 230 when the compressed boil-off gas, which is provided from the storage tank 20, is insufficient. Also, a pump gas line 240, which receives the boil-off gas from the main pump 150, may be connected to the compressor 220.

The discharge line 140 is connected to a lower portion of the drum 120. The main pump 150 is installed on the exhaust line 140. The main pump 150 applies a transfer pressure to the liquid cargo stored in the drum 120.

The cooling unit 300 prevents temperature increase of the storage tank 20 when the compressed boil-off gas is supplied to the storage tank 20. For example, the cooling unit 300 may include an injection nozzle 310, a cooling supply line 320, and an auxiliary pump 330.

The injection nozzle 310 is installed at an inner upper portion of the storage tank 20 to inject the liquid cargo.

The cooling supply line 320 connects the injection nozzle 310 and the drum 120. The auxiliary pump 330 applies a transfer pressure for supplying a portion of the liquid cargo stored in the drum 120 to the injection nozzle 310.

Figure 3:
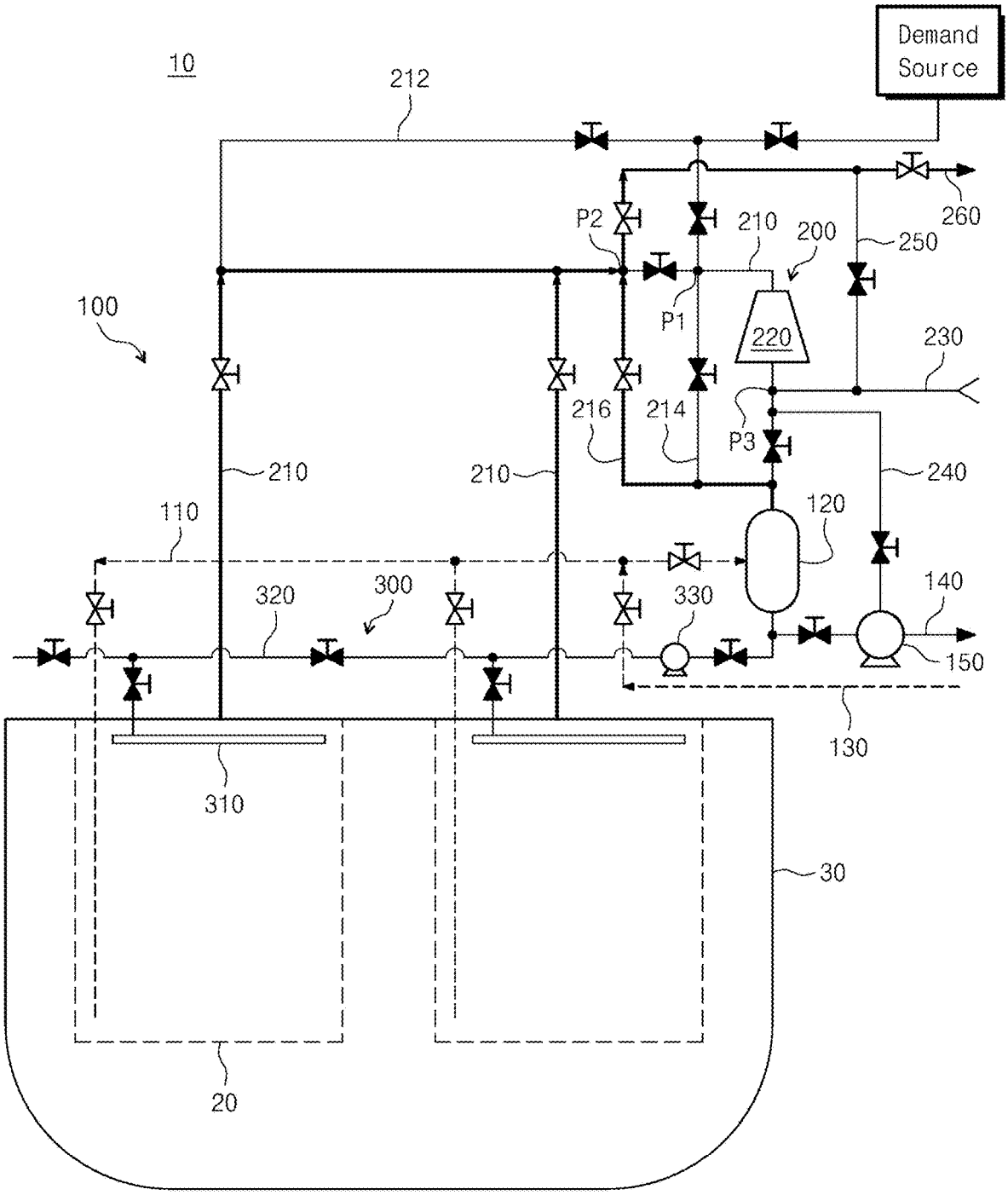
FIG. 3 is a view for explaining a process of loading a liquid cargo to a storage tank.

FIG. 3 is a view for explaining a process of loading (filling) the liquid cargo to the storage tank. For reference, a transfer path of the liquid cargo is expressed by a dotted line, and a transfer path of the boil-off gas is expressed by a thick solid line for convenience of description. Also, in FIGS. 3 to 8 and 11 to 13, a valve, which has an inside colored in black, of valves installed on each of the lines represents a closed state, and a valve, which is not colored in black, represents an opened state.

As illustrated in FIG. 3, the liquid cargo passes the liquid cargo transfer line 110 through the filling line 130 and is stored in the storage tank 20. Here, a portion of the liquid cargo is stored in the storage space of the drum 120. The liquid cargo stored in the storage space of the drum 120 may be used to cool down the main pump 150. The boil-off gas generated from the storage space of the drum 120 and the boil-off gas generated from the storage tank 20 may be supplied to an additional demand source through the exhaust line 260 connected to the bypass line 250.

Here, the additional demand source may require the boil-off gas and be driven by using the boil-off gas as a raw material. For example, the additional demand source may be an electric generator (e.g., DFDG), a gas combustion apparatus (GCU), or a boiler (e.g., a boiler generating steam). However, the embodiment of the inventive concept is not limited thereto.

Figure 4:
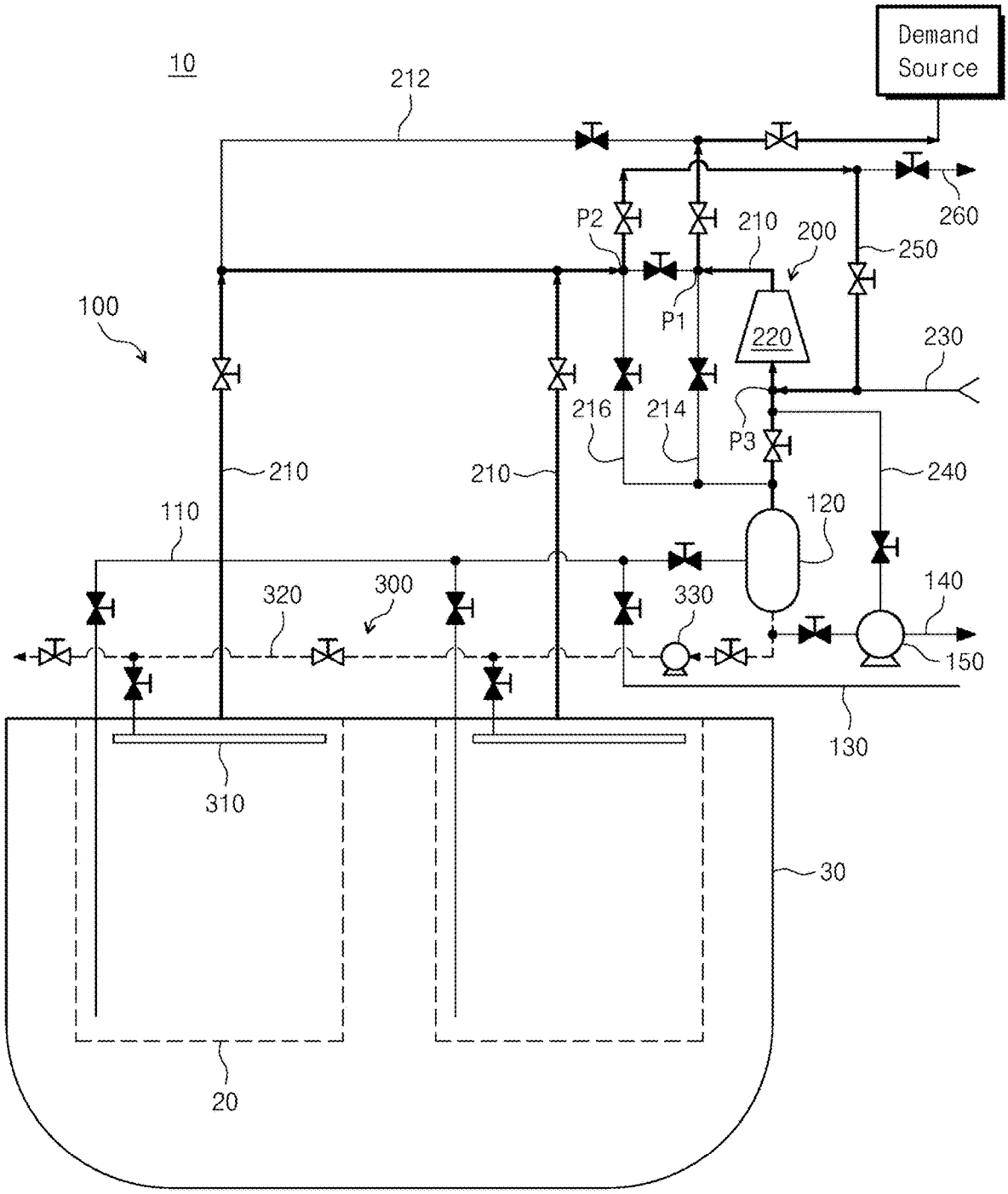
FIG. 4 is a view showing a movement path of a boil-off gas in case of a laden voyage.

FIG. 4 is a view showing a movement path of the boil-off gas in case of a laden voyage.

For reference, the transfer path of the liquid cargo is expressed by a dotted line, and the transfer path of the boil-off gas is expressed by a thick solid line for convenience of description.

Referring to FIG. 4, the boil-off gas generated in the storage tank 20 in case of the laden voyage, in which the liquid cargo is fully laden in the storage tank, may pass through the gas transfer line 210 and the bypass line 250, be compressed in the compressor 220, and then be supplied to the demand source through the demand source supply line 212. Also, when an amount of the boil-off gas generated in the storage tank 20 is insufficient, the boil-off gas in the drum 120 may be provided. Alternatively, the liquid cargo may be supplied to the demand source by using the auxiliary pump 330 installed on the cooling supply line 320.

For reference, the demand source may be a high pressure engine using the boil-off gas (or liquefied gas) that is evaporated by being compressed at a pressure of about 200 bar to about 400 bar by the compressor and using the high pressure boil-off gas at about 300 bar, or an engine for directly rotating a propeller shaft to drive a propeller or generating other powers.

Figure 5:
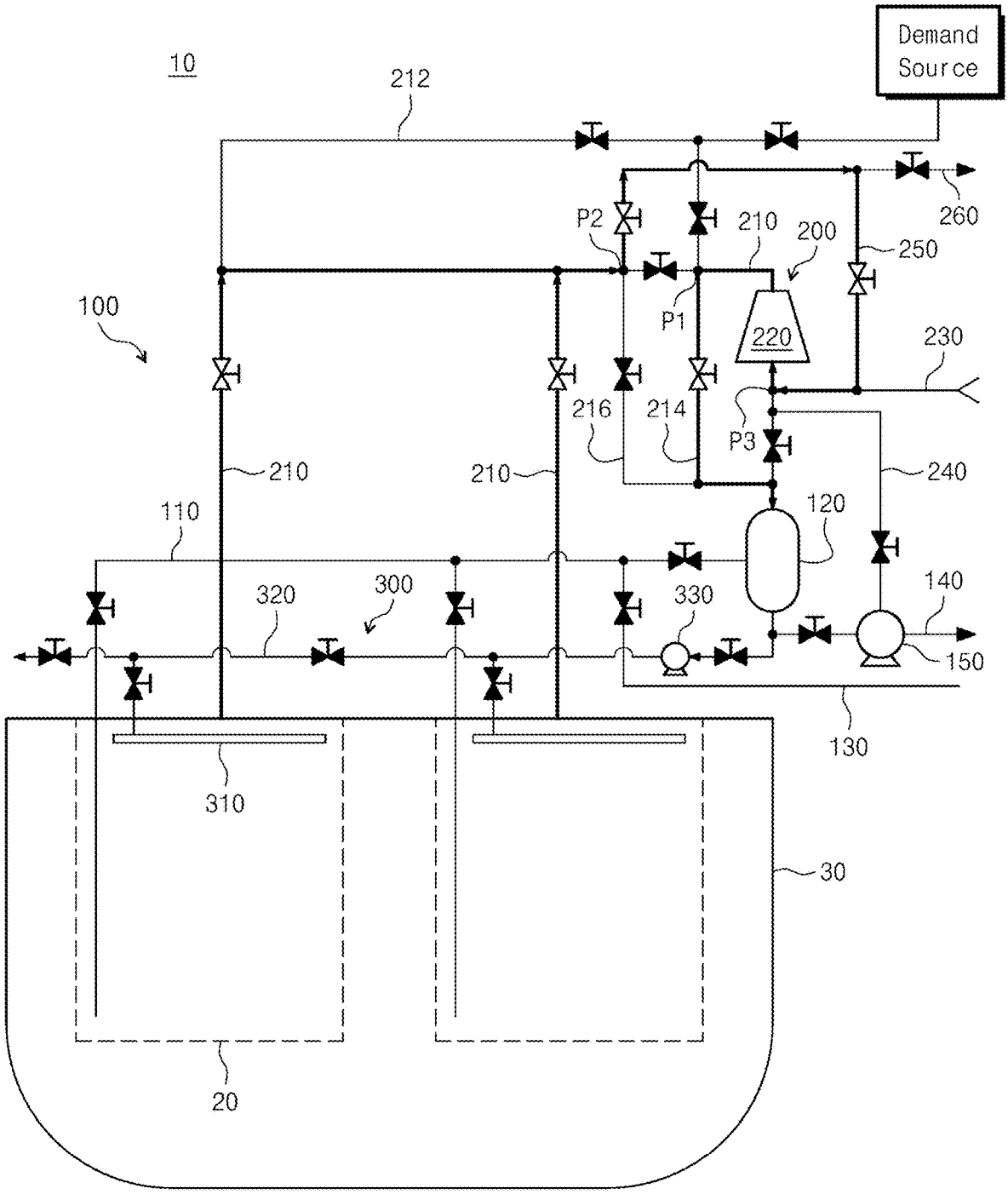
FIG. 5 is a view showing another movement path of the boil-off gas.

FIG. 5 is a view showing another movement path of the boil-off gas.

For reference, a movement path of the boil-off gas is expressed by a thick solid line for convenience of description.

Referring to FIG. 5, when an amount of the boil-off gas used in the demand source is reduced due to slow sailing, the surplus boil-off gas may be compressed through the compressor 220, and then stored in the drum 120 through the first drum gas line 215 at the first point P1.

Figure 6:
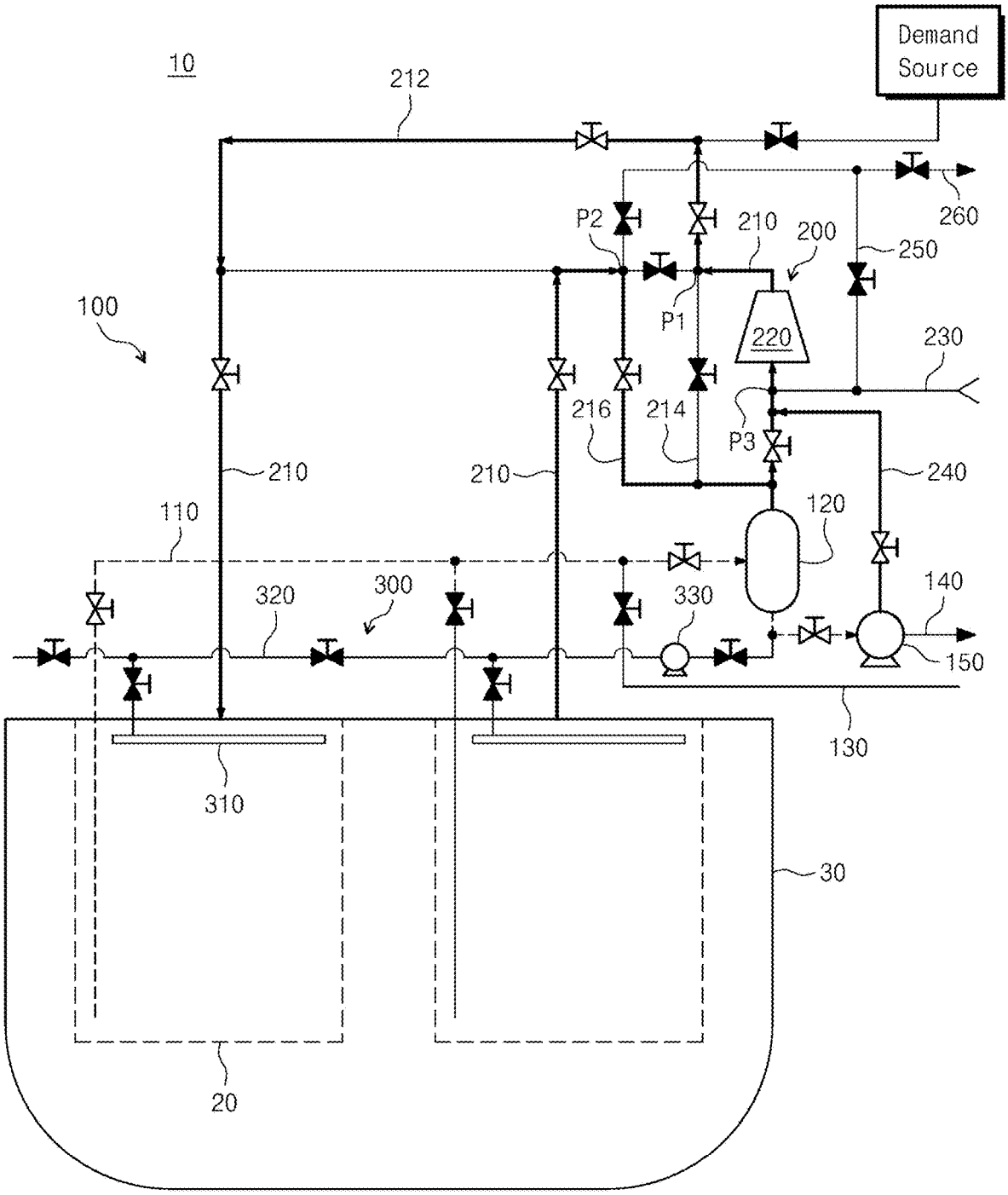
FIG. 6 is a view for explaining a process of cooling down a main pump.

FIG. 6 is a view for explaining a process of cooling down the main pump.

For reference, a movement path of the boil-off gas is expressed by a thick solid line for convenience of description.

Referring to FIG. 6, since the main pump 150 is exposed to the external atmosphere unlike the typical submerged pump installed in the storage tank, a cool-down process is necessary before performing an unloading operation. The cool-down of the main pump 150 is performed in advance by using the liquid cargo stored in the drum 120.

In this process, the boil-off gas generated from the main pump 150 is supplied to the compressor 220 through the pump gas line 240. Also, the boil-off gas in the drum 120 and the right side storage tank may be supplied to the compressor. The boil-off gas compressed in the compressor 220 (hereinafter, referred to as compressed boil-off gas) is supplied to the left side storage tank of the two storages tanks through the gas transfer line 210. The liquid cargo in the left side storage tank is transferred to the drum 120 through the liquid cargo transfer line 110 by the pressing force of the compressed boil-off gas. Thus, the drum 120 may receive the liquid cargo that is used for the cool-down of the main pump 150.

Figure 7:
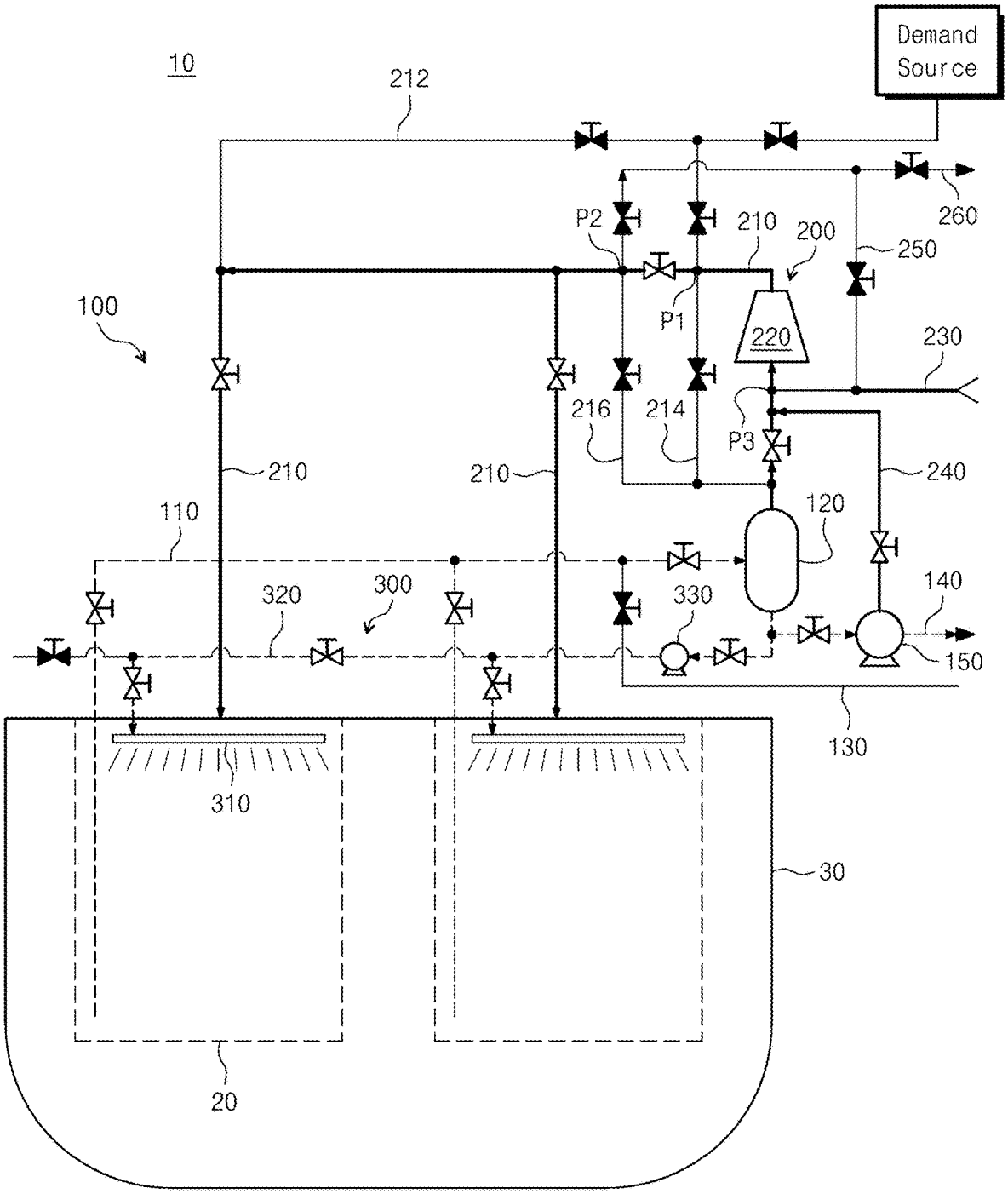
FIG. 7 is a view for explaining a process of unloading the liquid cargo from the storage tank.

FIG. 7 is a view for explaining a process of unloading the liquid cargo from the storage tank. For reference, the transfer path of the liquid cargo is expressed by a dotted line, and the transfer path of the boil-off gas is expressed by a thick solid line for convenience of description.

As illustrated in FIG. 7, the unloading operation is performed such that the pressing unit 200 presses the two storage tanks 20, and the liquid cargo stored in the storage tank 20 moves to the drum 120 through the liquid cargo transfer line 110 by the pressing force of the compressed boil-off gas.

In this compression process, since the compressed boil-off gas, which passes through the compressor 220, has a room temperature greater than the liquid cargo in the storage tank 20, the compressed boil-off gas may cause an inner temperature of the storage tank 20 to increase. In order to minimize the above-described limitation, the inner temperature increase of the storage tank 20 is restricted through the cooling unit 300 in the compression process. That is, when the liquid cargo is sprayed in the storage tank 20 while simultaneously pressing the compressed boil-off gas into the storage tank 20, the temperature increase of the storage tank 20 may be prevented as the low temperature liquid cargo cools the compressed boil-off gas, and a required amount of the compressed boil-off gas discharged through the compressor 220 may be reduced, thereby reducing a capacity of the compressor 220. The liquid cargo sprayed in the storage tank 20 is supplied from the drum 120.

Also, the liquid cargo moving from the storage tank 20 to the drum 120 is transferred to a liquid cargo storage terminal (e.g., a carrying vessel or a ground storage tank) (not shown) through the discharge line 140, and here, the liquid cargo is transferred by the main pump 150.

Figure 8:
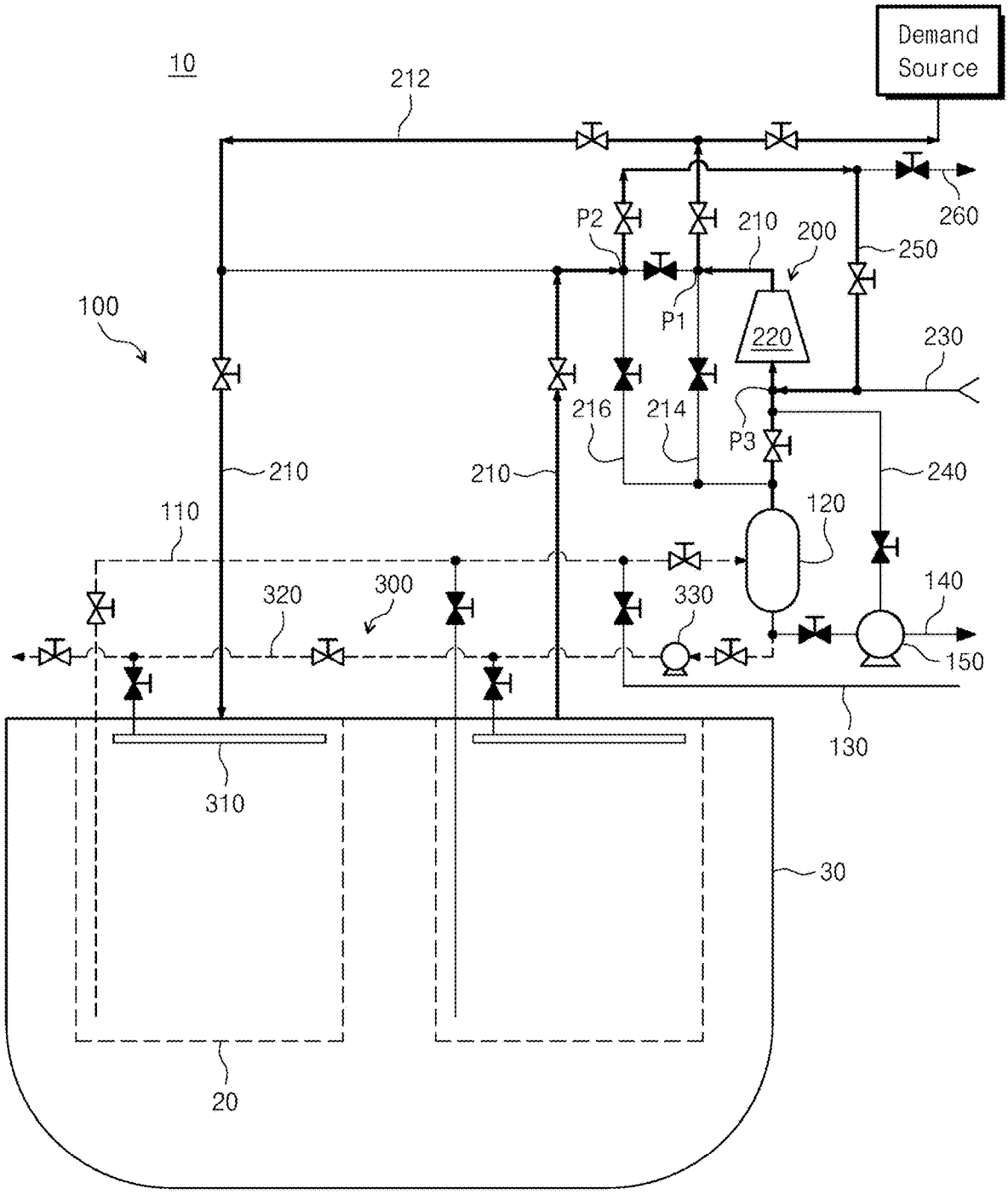
FIG. 8 is a view showing a transfer path of a boil-off gas in case of a ballast voyage.

FIG. 8 is a view showing the transfer path of the boil-off gas in case of a ballast voyage.

For reference, the movement path of the boil-off gas is expressed by a thick solid line for convenience of description.

Referring to FIG. 8, since an amount of the boil-off gas generated from the storage tank 20 is reduced in case of the ballast voyage, the required boil-off gas for sailing may receive from the liquid cargo stored in the drum 120. That is, the liquid cargo of the drum 120 may be supplied to an evaporator (not shown) through the liquid cargo cooling line 320 and then supplied to the demand source.

Figure 9:
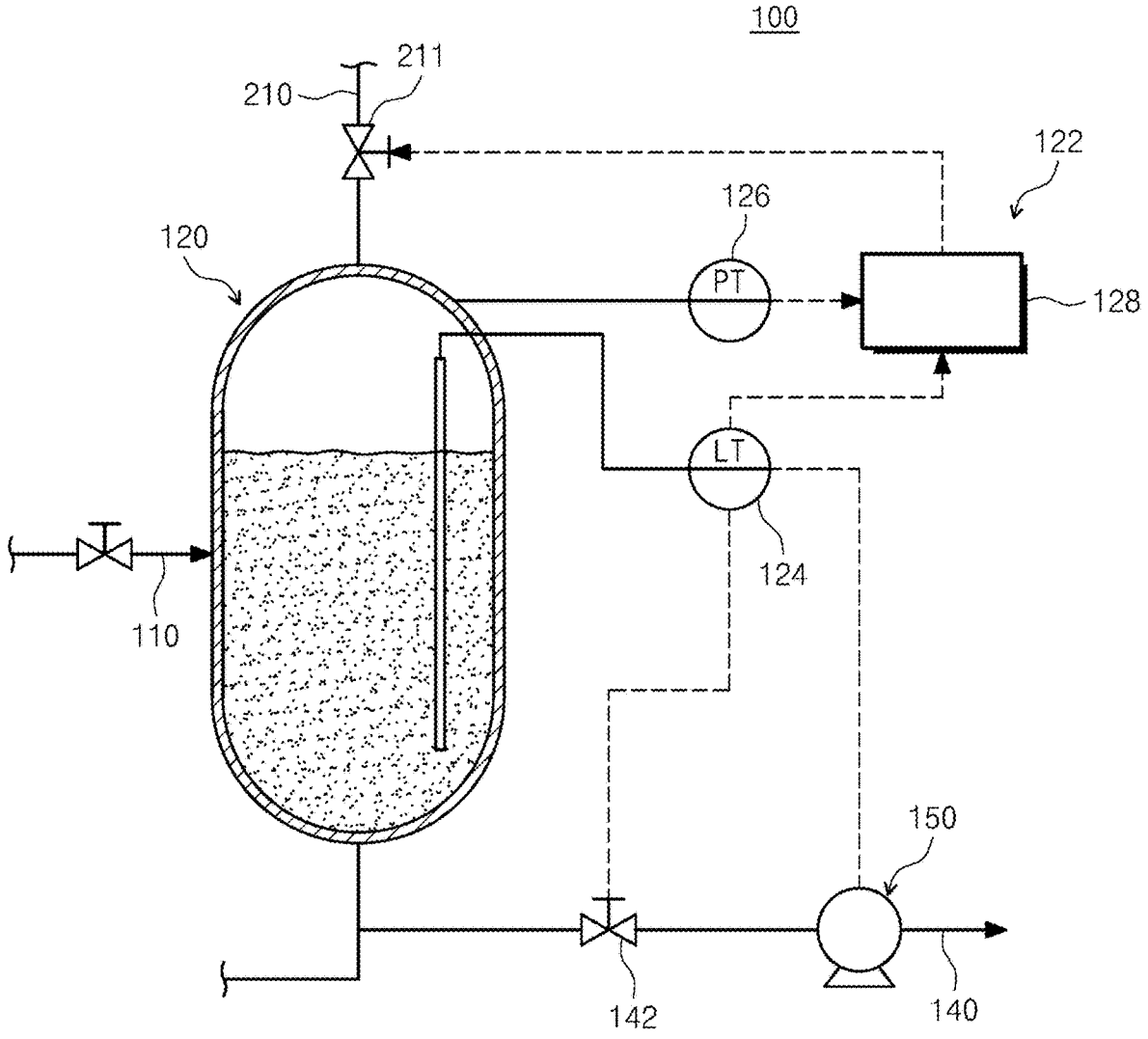
FIG. 9 is a view illustrating a configuration for adjusting a pressure of a drum in the liquid cargo transfer apparatus.

FIG. 9 is a view illustrating a configuration for adjusting a pressure of the drum in the liquid cargo transfer apparatus.

Referring to FIG. 9, the liquid cargo transfer apparatus 100 includes a drum pressure adjusting part 122. The drum pressure adjusting part 122 adjusts the pressure of the drum 120 to constantly maintain a flow amount of the liquid cargo discharged through the discharge line 140.

For example, the drum pressure adjusting part 122 may include: a water level detecting member 124 for measuring a water level of the liquid cargo in the drum 120; a pressure measuring member 126 for measuring a pressure of the boil-off gas in the drum 120; and a controller 128 for receiving a measured value from the water level detecting member 124 and the pressure measuring member 126 to control a discharge amount of the boil-off gas in the drum 120.

The controller 128 may control each of a vapor control valve 211 installed on the gas transfer line 210 through which the boil-off gas in the drum 120 is discharged and a control valve 142 installed on the discharge line 140 and the main pump 150.

The controller 128 controls the vapor control valve 211 so that an amount of the boil-off gas exhausted through the gas transfer line 210 decreases when the water level of the liquid cargo in the drum 120 increases more than a preset water level, and the pressure of the boil-off gas in the drum 120 is low. Also, the controller 128 controls the vapor control valve 211 so that the amount of the boil-off gas exhausted through the gas transfer line 210 increases when the water level of the liquid cargo in the drum 120 increases more than the preset water level, and the pressure of the boil-off gas in the drum 120 is high.

Figure 10:
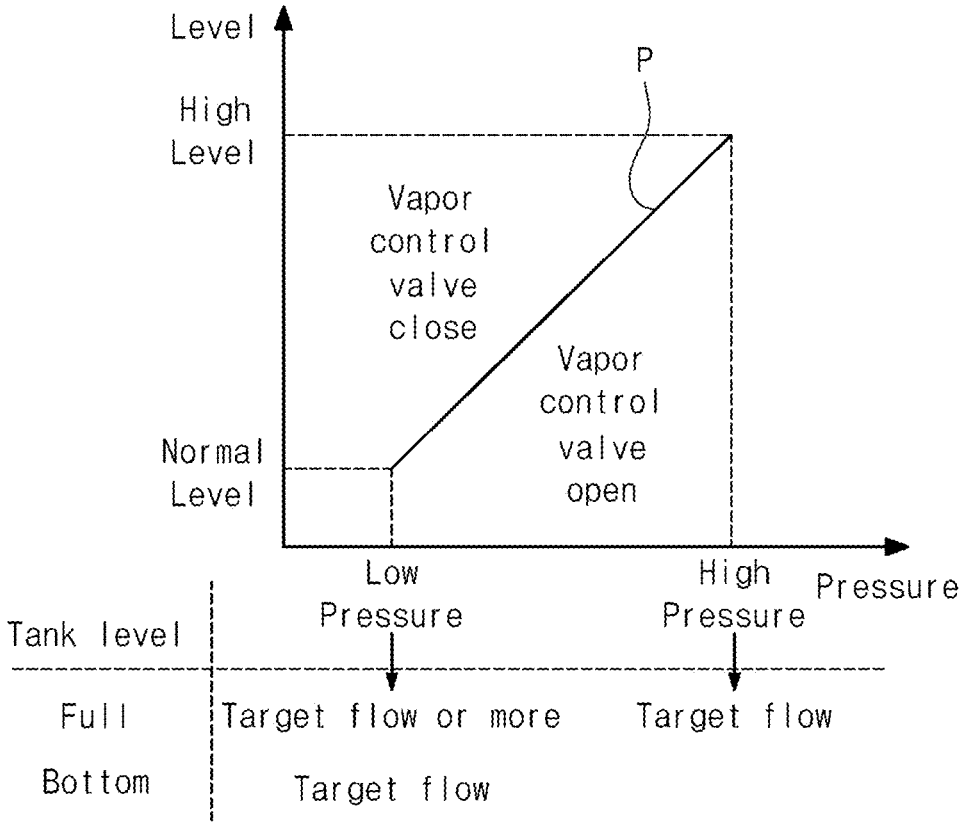
FIG. 10 is a table showing a pressure curve of a boil-off gas and a water level in the drum.

As described above, when a flow amount introduced to the drum 120 is greater than that discharged through the discharge line 140, the water level of the drum 120 increases, and thus the pressure in the drum 120 increases. Since a pressure difference between the storage tank 20 and the drum 120 decreases, the flow amount introduced to the drum 120 naturally decreases. On the contrary, when the water level of the drum 120 decreases, as the pressure in the drum 120 decreases, and thus the flow amount introduced to the drum 120 increases, the flow amounts introduced to and discharged from the drum 120 may be constantly adjusted. Since the liquid cargo in the drum 120 is evaporated by introduced heat, the inside of the drum 120 is pressed. Here, the pressure in the drum may be controlled on the basis of a pressure curve P of the boil-off gas and the water level as in FIG. 10.

Figure 11:
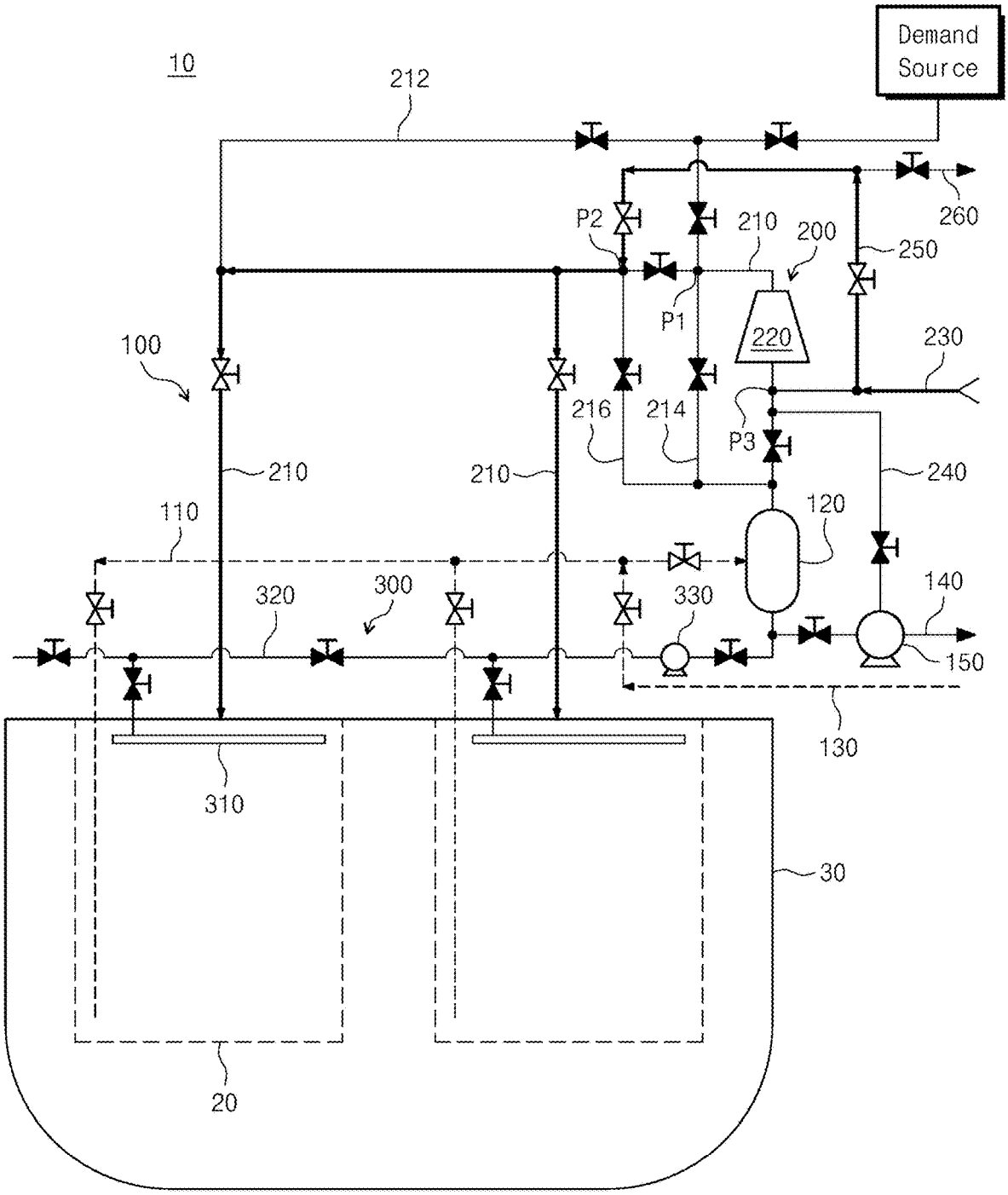
FIG. 11 is a view for explaining a process of preventing a drastic pressure reduction of the storage tank by using a boil-off gas supplied from a liquid cargo storage terminal when the liquid cargo is loaded to the storage tank.

FIG. 11 is a view for explaining a process of preventing a drastic pressure reduction of the storage tank by using the boil-off gas supplied from the liquid cargo storage terminal when the liquid cargo is loaded to the storage tank.

When the liquid cargo is loaded to the storage tank 20 from an external tank such as the carrying vessel or the liquid cargo storage terminal (e.g., the ground storage tank), a remained gas in the storage tank 20 may be rapidly contracted to drastically reduce the pressure thereof due to a temperature difference between the liquid cargo stored in the storage tank 20 and the liquid cargo supplied to the storage tank 20.

When the pressure in the storage tank 20, which is a membrane tank, decreases to a negative pressure, a primary barrier contacting the liquid cargo of the storage tank 20 has an extremely high damage possibility. Although the rapid contraction of the gas in the storage tank 20 may be prevented by slowing down a speed of loading the liquid cargo to the storage tank 20, there is a limitation in that productivity is degraded because of a long loading time, and thus continuous monitoring is required.

As illustrated in FIG. 11, when the liquid cargo is loaded to the storage tank 20, the boil-off gas may be sequentially transferred from an external tank such as a terminal or a bunker vessel through the terminal gas line 230, the bypass line 250, the exhaust line 260, and the gas transfer line 210 and supplied into the storage tank 20. As described above, when the boil-off gas (natural gas) is received from the external tank such as the terminal or the bunker vessel and injected into the storage tank 20 in case of loading the liquid cargo to the storage tank 20, the rapid contraction of the gas in the storage tank 20 may be prevented without slowing down the speed of loading the liquid cargo to prevent the damage generated on the membrane barrier of the storage tank 20.

Figure 12:
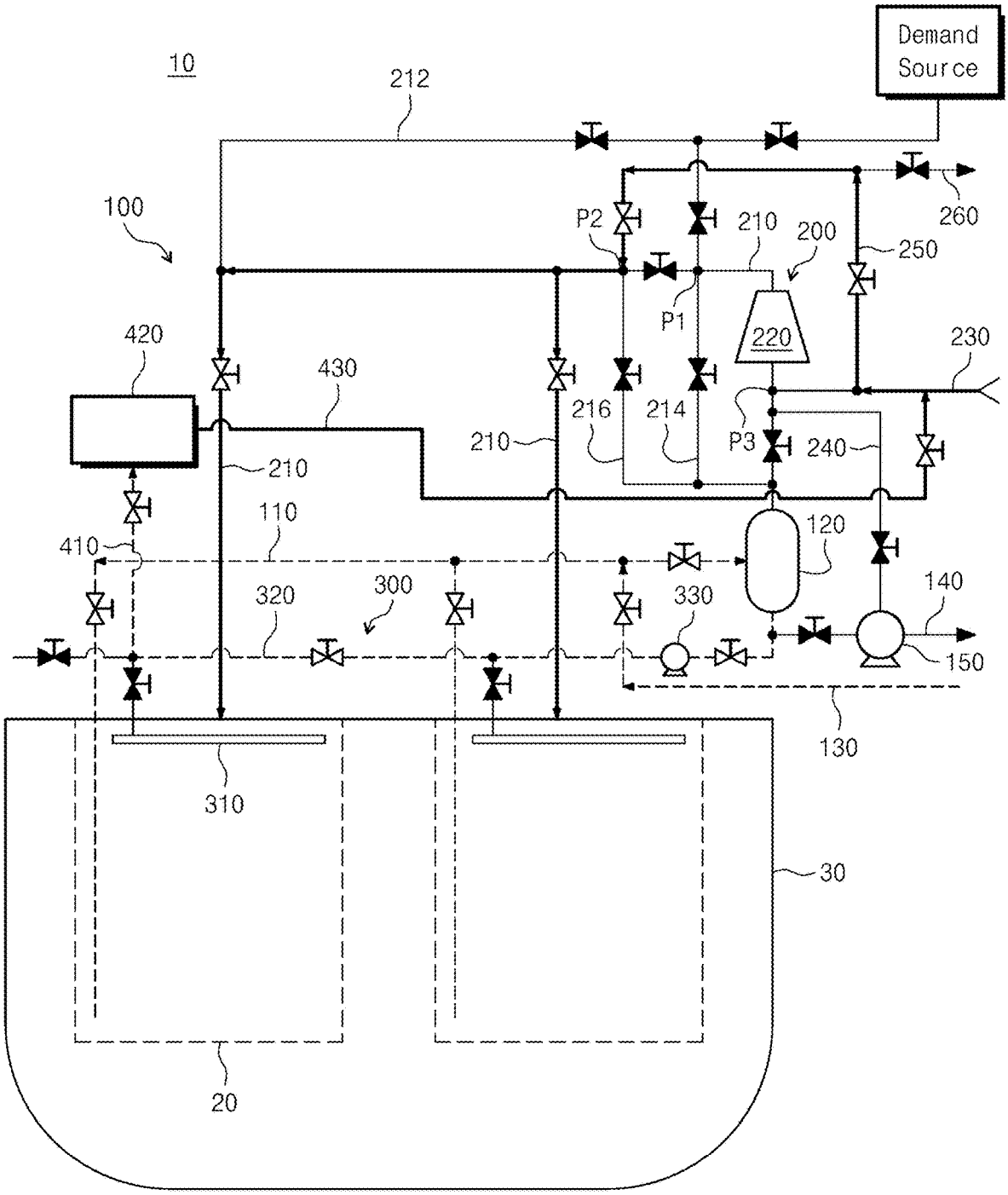
FIG. 12 is a view for explaining a process of preventing a drastic pressure reduction of the storage tank by evaporating a liquid cargo stored in the drum and supplying the liquid cargo to the storage tank when the liquid cargo is loaded to the storage tank.

FIG. 12 is a view for explaining a process of preventing a drastic pressure reduction of the storage tank by evaporating the liquid cargo stored in the drum and supplying the liquid cargo to the storage tank when the liquid cargo is loaded to the storage tank.

In the embodiment illustrated in FIG. 12, a liquid cargo supply line 410 is connected to the cooling supply line 320. The liquid cargo stored in the drum 120 is supplied to an evaporator 420 through the cooling supply line 320 and the liquid cargo supply line 410, evaporated in the evaporator 420, and then supplied to a gas supply line 430 connected to the terminal gas line 230. The gas evaporated in the evaporator 420 is sequentially transferred through the gas supply line 430, the terminal gas line 230, the bypass line 250, the exhaust line 260, and the gas transfer line 210 and supplied into the storage tank 20.

As described above, as the liquid cargo supplied from the drum 120 is evaporated and then supplied into the storage tank 20 when the liquid cargo is loaded to the storage tank 20, the rapid contraction of the gas in the storage tank 20 may be prevented without slowing down the speed of loading the liquid cargo to prevent the damage generated on the membrane barrier of the storage tank 20. Also, according to the embodiment in FIG. 12, although a sufficient amount of the boil-off gas is not supplied from a terminal or a tank of a bunker vessel, drastic pressure decrease of the storage tank 20 may be prevented.

Figure 13:
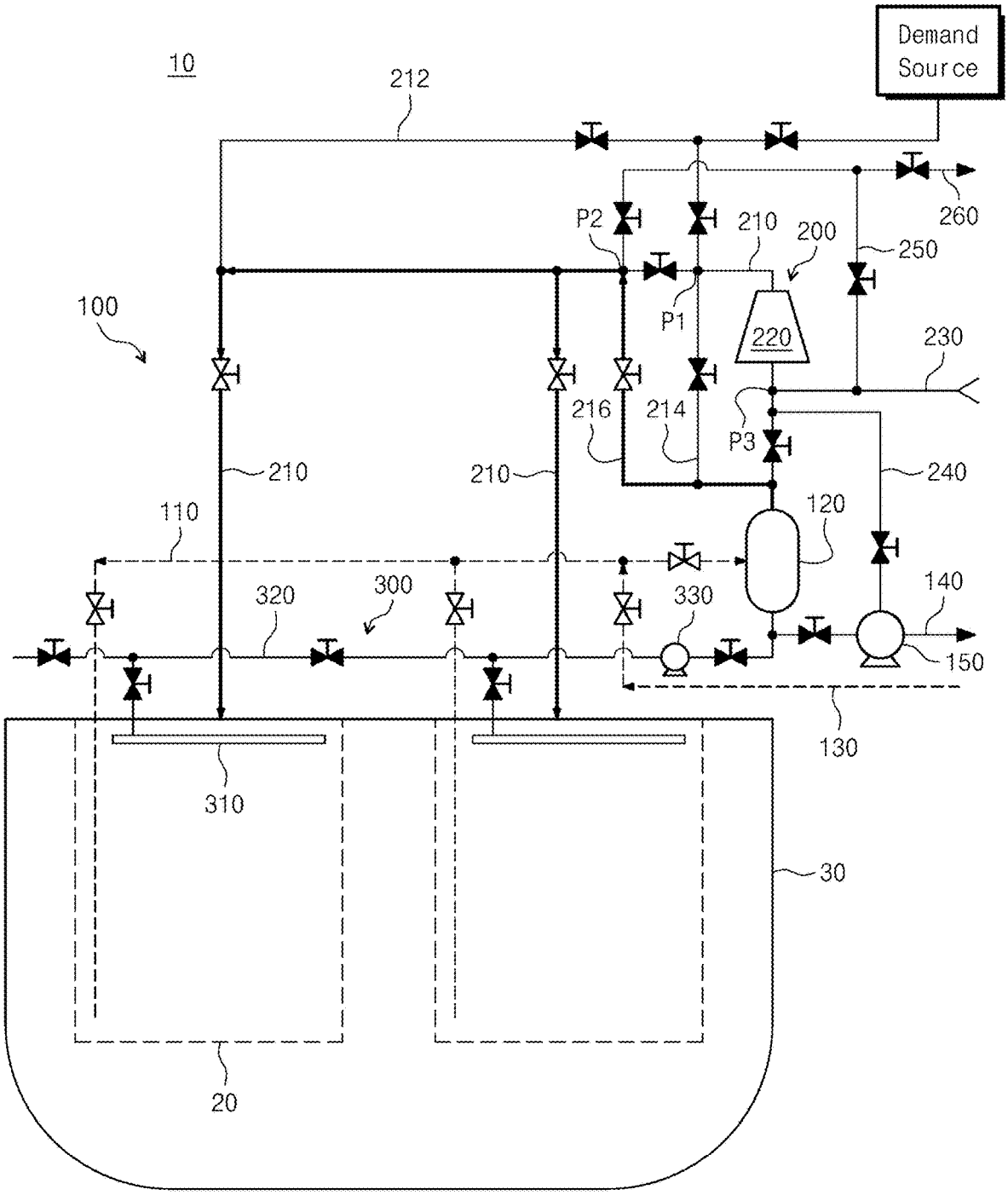
FIG. 13 is a view for explaining a process of preventing a drastic pressure reduction of the storage tank by supplying a boil-off gas of the drum into the storage tank when the liquid cargo is loaded to the storage tank.

FIG. 13 is a view for explaining a process of preventing a drastic pressure reduction of the storage tank by supplying the boil-off gas of the drum into the storage tank when the liquid cargo is loaded to the storage tank.

As illustrated in FIG. 13, when the liquid cargo is loaded to the storage tank 20, as the boil-off gas (natural gas) of the drum 120 is sequentially transferred through the second drum gas line 216 and the gas transfer line and supplied into the storage tank 20, the rapid contraction of the gas in the storage tank 20 may be prevented without slowing down the speed of loading the liquid cargo to prevent the damage generated on the membrane barrier of the storage tank 20. Also, according to the embodiment in FIG. 13, although a sufficient amount of the boil-off gas is not supplied from a terminal or a tank of a bunker vessel, drastic pressure decrease of the storage tank 20 may be prevented.

Although not shown, two or more methods of the method for supplying the boil-off gas supplied from the external tank such as the terminal or the bunker vessel into the storage tank, the method for supplying the boil-off gas of the drum 120 into the storage tank 20, and the method for supplying the gas obtained by evaporating the liquid cargo supplied from the drum 120 into the storage tank 20 may be simultaneously used to prevent the drastic pressure decrease of the storage tank 20 when the liquid cargo is loaded.

The above-disclosed subject matter is to be considered illustrative, and not restrictive, and the appended claims are intended to cover all such modifications, enhancements, and other embodiments, which fall within the true spirit and scope of the present disclosure. The invention may, however, be embodied in many different forms and should not be construed as being limited to the embodiments set forth herein. Rather, these embodiments are provided so that this disclosure will be thorough and complete, and will fully convey the concept of the invention to those skilled in the art. Therefore, the scope of the invention is defined not by the detailed description of the invention but by the appended claims, and all differences within the scope will be construed as being included in the present disclosure.

The invention claimed is:

1. An apparatus for transferring a liquid cargo, the apparatus comprising:

a liquid cargo transfer line connected to a liquid cargo storage tank;

a drum connected to the liquid cargo transfer line and configured to provide a space for storing a liquid cargo; and a pressing unit configured to press the liquid cargo storage tank so that the liquid cargo stored in the liquid cargo storage tank is supplied to the drum through the liquid cargo transfer line, wherein the pressing unit comprises:

a compressor configured to receive a boil-off gas from the drum and compress the received boil-off gas; and a gas transfer line configured to supply the boil-off gas, which is compressed in the compressor, to the liquid cargo storage tank.

2. The apparatus of claim 1, further comprising a filling line connected to the liquid cargo transfer line and configured to receive the liquid cargo from an outside.

3. The apparatus of claim 1, wherein the pressing unit further comprises a terminal gas line connected to the compressor and configured to supply a boil-off gas from a liquid cargo storage terminal.

4. The apparatus of claim 1, further comprising a cooling unit configured to prevent temperature increase of the liquid cargo storage tank when the compressed boil-off gas is supplied to the liquid cargo storage tank.

5. The apparatus of claim 4, wherein the cooling unit comprises:

an injection nozzle installed in the liquid cargo storage tank to inject the liquid cargo; and a cooling supply line configured to connect the injection nozzle with the drum and supply a portion of the liquid cargo stored in the drum to the injection nozzle by an auxiliary pump.

6. The apparatus of claim 1, wherein the pressing unit further comprises a bypass line bypassing the compressor and connected to the gas transfer line, and the boil-off gas generated from the liquid cargo storage tank is supplied between the compressor and the drum through the gas transfer line and the bypass line, compressed in the compressor, and then supplied to a gas demand source.

7. The apparatus of claim 6, further comprising:

a collecting line configured to store surplus boil-off gas, which is remained from the boil-off gas compressed in the compressor after supplied to the gas demand source, in the drum; and an exhaust line branched from the gas transfer line and configured to exhaust a boil-off gas generated from the drum.

8. The apparatus of claim 1, further comprising:

a discharge line connected to a lower portion of the drum in order to unload the liquid cargo stored in the drum; and a main pump installed on the discharge line and configured to apply a transfer pressure to the liquid cargo stored in the drum to pump the liquid cargo.

9. The apparatus of claim 8, further comprising a drum pressure adjusting part configured to adjust a pressure of the drum in order to constantly maintain a flow amount of the liquid cargo discharged through the discharge line.

10. The apparatus of claim 9, wherein the drum pressure adjusting part comprises:

a water level detecting member configured to measure a water level of the liquid cargo in the drum;

a pressure measuring member configured to measure a pressure of a boil-off gas in the drum; and a controller configured to receive a measured value from the water level detecting member and the pressure measuring member and control a discharge amount of the boil-off gas in the drum, wherein the controller controls a vapor control valve installed on a gas transfer line through which the boil-off gas in the drum is discharged and a control valve installed on the discharge line and the main pump, wherein the controller controls the vapor control valve so that an amount of the boil-off gas exhausted through the gas transfer line decreases when the pressure of the boil-off gas in the drum with respect to the water level of the liquid cargo in the drum is less than a preset ratio, and controls the vapor control valve so that the amount of the boil-off gas exhausted through the gas transfer line increases when the pressure of the boil-off gas in the drum with respect to the water level of the liquid cargo in the drum is greater than a preset ratio.

11. The apparatus of claim 1, wherein the pressing unit prevents pressure decrease of the liquid cargo storage tank by supplying at least one of a boil-off gas supplied from a liquid cargo storage terminal, a boil-off gas generated in the drum, and a gas obtained by evaporating the liquid cargo stored in the drum to the liquid cargo storage tank through the gas transfer line when the liquid cargo is loaded from the liquid cargo storage terminal to the liquid cargo storage tank.

12. A method for transferring a liquid cargo, the method comprising:

pressing a liquid cargo storage tank by using a boil-off gas so that a liquid cargo stored in the liquid cargo storage tank is transferred to a drum; and discharging the liquid cargo stored in the drum to a liquid cargo storage terminal through pumping of a main pump, wherein the boil-off gas used to press the liquid cargo storage tank comprises a compressed boil-off gas obtained by compressing a boil-off gas, which is generated in the drum, in a compressor.

13. The method of claim 12, wherein the pressing of the liquid cargo storage tank receives and uses a boil-off gas generated in the liquid cargo storage terminal when the boil-off gas used to press the liquid cargo storage tank is insufficient, and prevents temperature increase of the liquid cargo storage tank by inserting and pressing the compressed boil-off gas into the liquid cargo storage tank while simultaneously injecting the liquid cargo supplied from the drum.

14. The method of claim 13, wherein a portion of the liquid cargo is stored in the drum when the liquid cargo is unloaded from the liquid cargo storage tank, cool-down of a pump, which is performed before the main pump is used, is performed by using the liquid cargo stored in the drum, and a boil-off gas generated during the cool-down of the pump is supplied to the liquid cargo storage tank.

* * * * *